US008480215B2

(12) United States Patent
Nakamura

(10) Patent No.: US 8,480,215 B2
(45) Date of Patent: Jul. 9, 2013

(54) IMAGE FORMING APPARATUS AND ATMOSPHERIC AIR OPENING METHOD

(75) Inventor: Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 13/049,083

(22) Filed: Mar. 16, 2011

(65) Prior Publication Data

US 2011/0228016 A1 Sep. 22, 2011

(30) Foreign Application Priority Data

Mar. 17, 2010 (JP) ..... 2010-060757

(51) Int. Cl.
*B41J 2/175* (2006.01)

(52) U.S. Cl.
USPC ..... 347/85

(58) Field of Classification Search
USPC ..... 347/85
See application file for complete search history.

(56) References Cited

U.S. PATENT DOCUMENTS

| | | | | |
|---|---|---|---|---|
| 6,010,204 | A * | 1/2000 | Morioka et al. | 347/37 |
| 7,540,598 | B2 | 6/2009 | Hori et al. | |
| 2003/0038865 | A1 * | 2/2003 | Inamura | 347/85 |
| 2005/0157041 | A1 * | 7/2005 | Inoue | 347/40 |
| 2006/0164475 | A1 * | 7/2006 | Umeda et al. | 347/85 |
| 2006/0170969 | A1 * | 8/2006 | Koga et al. | 358/1.18 |
| 2008/0136849 | A1 * | 6/2008 | Kaneko | 347/7 |
| 2008/0273046 | A1 * | 11/2008 | Ishinaga et al. | 347/6 |
| 2008/0291240 | A1 | 11/2008 | Ohsako et al. | |
| 2009/0057981 | A1 * | 3/2009 | Fukasawa et al. | 271/3.09 |

FOREIGN PATENT DOCUMENTS

| | | |
|---|---|---|
| JP | 10-67116 | 3/1998 |
| JP | 2805381 | 7/1998 |
| JP | 2007-15153 | 1/2007 |
| JP | 2007-125825 | 5/2007 |
| JP | 4155879 | 7/2008 |
| JP | 2008-179103 | 8/2008 |

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus includes a sub tank that supplies a liquid to a head that ejects liquid droplets, the sub tank including a generating unit that generates a negative pressure inside the sub tank by expanding and contracting as the liquid is supplied to and ejected from the sub tank, and an opening mechanism that performs an opening operation of opening the sub tank to atmospheric air; a supply mechanism that supplies the liquid in a main tank to the sub tank; a carriage that moves in a main scanning direction above a sheet, the head being disposed in the carriage; a moving mechanism that changes a distance between the sheet and the head; and a control unit that causes the opening mechanism to perform the opening operation in conjunction with the moving mechanism changing the distance between the sheet and the ejecting head.

3 Claims, 9 Drawing Sheets

IMAGE FORMING APPARATUS AND ATMOSPHERIC AIR OPENING METHOD

BACKGROUND OF THE INVENTION

1. Field of the Invention

The present invention relates to a liquid droplet ejecting type image forming apparatus and an atmospheric air opening method of a sub tank of a liquid droplet ejecting type recording head.

2. Description of the Related Art

In a liquid droplet ejecting type image forming apparatus, for example, an inkjet type image forming apparatus, a head unit is provided with a sub tank, and an amount of ink that has been consumed at a recording head is supplied to the sub tank from a main tank. For example, as described in patent document 1, when air enters a supply path to the sub tank, a failure may occur in the negative pressure in the sub tank for a certain time period. Therefore, a negative pressure recovery operation involving an atmospheric air opening operation is performed. The negative pressure recovery operation involving an atmospheric air opening operation is preferably performed only when air enters the supply path, because ink is consumed by performing these operations. However, in order to perform the negative pressure recovery operation involving an atmospheric air opening operation only when air enters the supply path, it would be necessary to determine whether air has entered the supply path. Thus, in consideration of ink consumption, there are two types of negative pressure recovery operations. One type is a negative pressure recovery operation involving an atmospheric air opening operation, and another type is a negative pressure recovery operation that does not involve an atmospheric air opening operation.

FIG. 9 is an exploded perspective view of a conventional inkjet head unit. As shown in FIG. 9, a head unit 1 includes heads 3 on which sub tanks 4 are mounted, an ink supply mechanism 2 for supplying ink to the sub tanks 4, a carriage 5 carrying the heads 3 corresponding to four colors that moves in a main scanning direction, and a support shaft 6 that supports the carriage 5 such that the carriage 5 is movable in the main scanning direction. The ink supply mechanism 2 is used to supply ink from ink cartridges 2Y, 2M, 2C, and 2K corresponding to the respective colors of YMCK, to the sub tanks 4 corresponding to the respective colors provided above the heads 3. The sub tank 4 maintains a negative pressure required for ejecting ink, and constantly maintains a fixed negative pressure for preventing the ink inside the sub tank 4 from dripping out. A flexible film is adhered to the side surfaces of the sub tank 4. The flexible film expands and contracts in accordance with the pressure inside the sub tank 4, so that the internal volume changes. Accordingly, the ink in the sub tank 4 is consumed. The sub tank 4 has negative pressure until a predetermined amount of ink is consumed, and the sub tank 4 may continue to maintain the negative pressure.

The negative pressure is attained by opening the sub tank 4 to atmospheric air so that atmospheric pressure is attained, and ejecting a predetermined amount of ink. For this purpose, the sub tank 4 is provided with an atmospheric air opening mechanism 7. The atmospheric air opening mechanism 7 of the sub tank 4 mounted on the carriage 5 is activated by pressing a pin 8 with a lever 10 of a solenoid 9. The pin 8 contacts the atmospheric air opening mechanism 7 via a pin hole (through hole) 11 provided in the carriage 5, from a direction perpendicular to the carriage moving direction, to activate the atmospheric air opening mechanism 7.

The negative pressure in the sub tank 4 may not be maintained if gas enters the sub tank 4 as time passes or when the ink cartridges 2Y, 2M, 2C, and 2K are replaced. When the negative pressure is no longer maintained, the negative pressure needs to be attained once again. To attain the negative pressure, a predetermined amount of ink is ejected as described above, and therefore ink is wasted. Therefore, the atmospheric air opening operation is preferably not performed under regular circumstances; the atmospheric air opening operation is preferably performed only when necessary. Accordingly, a separate driving mechanism such as a solenoid shown in FIG. 9 is typically provided. Examples are disclosed in patent document 2 and patent document 3.

Meanwhile, in recent years and continuing, printers are being used by users for versatile purposes. Accordingly, there is a wide variety of paper types being used. Particularly, there is a wide variety of paper types with different thicknesses (plain paper, post cards, cardboard, envelopes, etc.). In order to address the wide variety of paper types, patent document 4 discloses a mechanism for adjusting the gap between the paper sheet and the image forming mechanism (head gap).

When a magnet valve or a solenoid is provided for selecting the atmospheric air opening operation as described above, the number of components increases, the control operation becomes complex, and the apparatus size becomes large. Meanwhile, as described in patent document 4, there is known a mechanism for adjusting the gap between the paper sheet and the image forming mechanism. This mechanism is only used for adjusting the gap.

Patent Document 1: Japanese Laid-Open Patent Publication No. 2007-15153

Patent Document 2: Japanese Patent No. 4155879

Patent Document 3: Japanese Laid-Open Patent Publication No. 2007-125825

Patent Document 4: Japanese Laid-Open Patent Publication No. 2008-179103

SUMMARY OF THE INVENTION

The present invention provides an image forming apparatus and an atmospheric air opening method, in which one or more of the above-described disadvantages are eliminated.

A preferred embodiment of the present invention provides an image forming apparatus and an atmospheric air opening method, in which a function that is intrinsically provided in a head unit such as a gap adjustment mechanism is used for performing an atmospheric air opening operation, so that the number of components is reduced and the apparatus is simplified.

According to an aspect of the present invention, there is provided an image forming apparatus including a sub tank that supplies a liquid to an ejecting head that ejects liquid droplets, the sub tank including a negative pressure generating unit that generates a negative pressure inside the sub tank by expanding and contracting as the liquid is supplied to and ejected from the sub tank, and an atmospheric air opening mechanism that performs an atmospheric air opening operation of opening the sub tank to atmospheric air; a supply mechanism that supplies the liquid in a main tank to the sub tank; a carriage that moves in a main scanning direction above a sheet, the ejecting head being disposed in the carriage; a moving mechanism that changes a distance between the sheet and the ejecting head; and an atmospheric air opening control unit that causes the atmospheric air opening mechanism to perform the atmospheric air opening operation in conjunction with the moving mechanism changing the distance between the sheet and the ejecting head.

According to an aspect of the present invention, there is provided an atmospheric air opening method of opening a sub tank to atmospheric air, the sub tank supplying a liquid to an ejecting head that ejects liquid droplets, the sub tank including a negative pressure generating unit that generates a negative pressure inside the sub tank by expanding and contracting as the liquid is supplied to and ejected from the sub tank, and an atmospheric air opening mechanism that performs an atmospheric air opening operation of opening the sub tank to atmospheric air, the liquid being supplied to the sub tank from a main tank, the atmospheric air opening method including moving a carriage in a main scanning direction above a sheet, the ejecting head being disposed in the carriage; changing a distance between the sheet and the ejecting head, the changing being performed before or after the moving; and causing a protruding member provided separately from the atmospheric air opening mechanism to come in contact with the atmospheric air opening mechanism of the sub tank at a predetermined position in conjunction with the moving or the changing, to open the sub tank to the atmospheric air.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

An embodiment of the present invention includes a feature of performing an atmospheric air opening operation with the use of functions that are intrinsically provided in a head unit, such as operations of moving a carriage and adjusting a gap.

Figure 9:
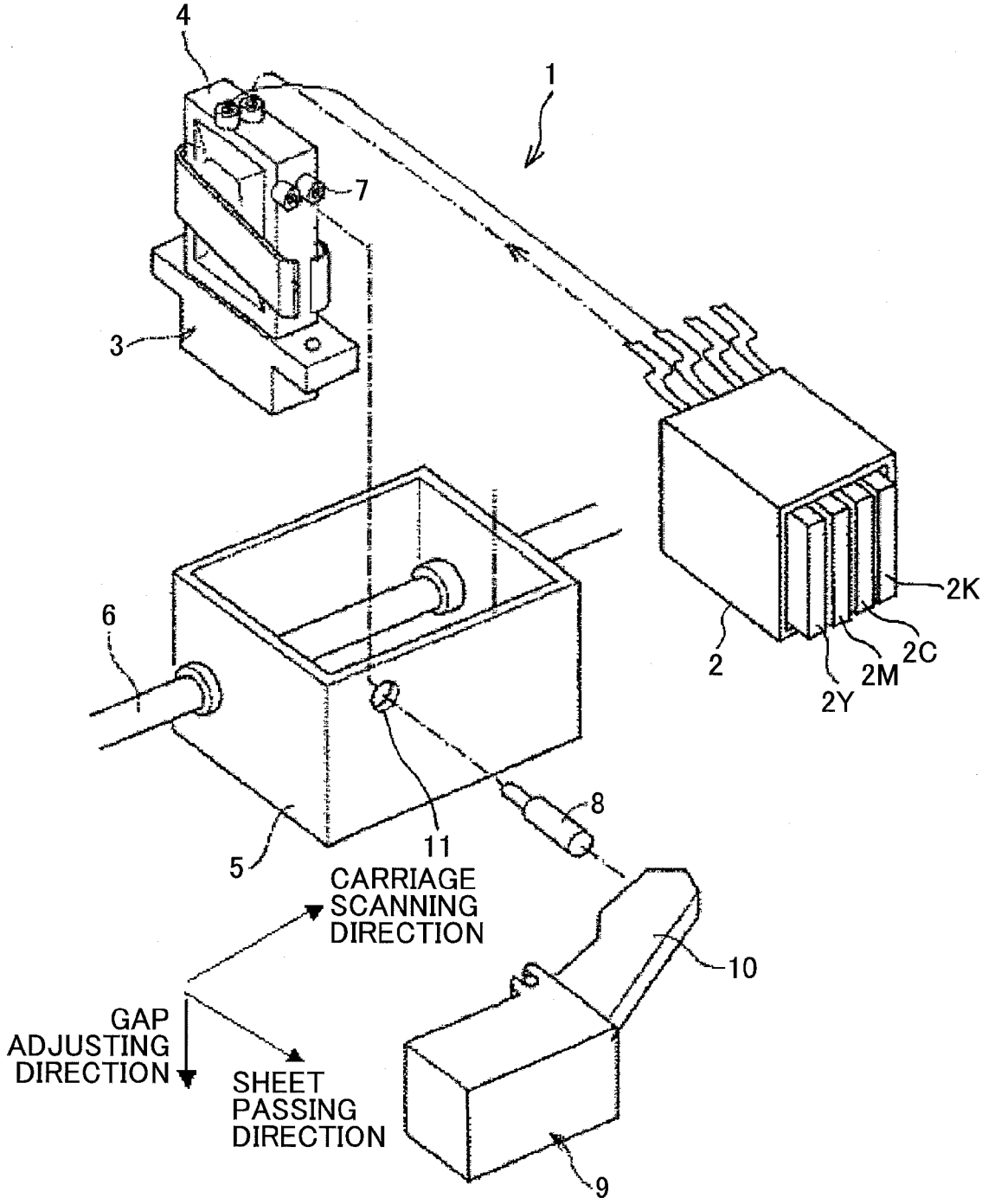
FIG. 9 is an exploded perspective view of a conventional atmospheric air opening device.

A description is given, with reference to the accompanying drawings, of embodiments of the present invention. Elements corresponding to those of the conventional example described with reference to FIG. 9 are denoted by the same reference numerals and are not further described.

First Embodiment

Figure 1:
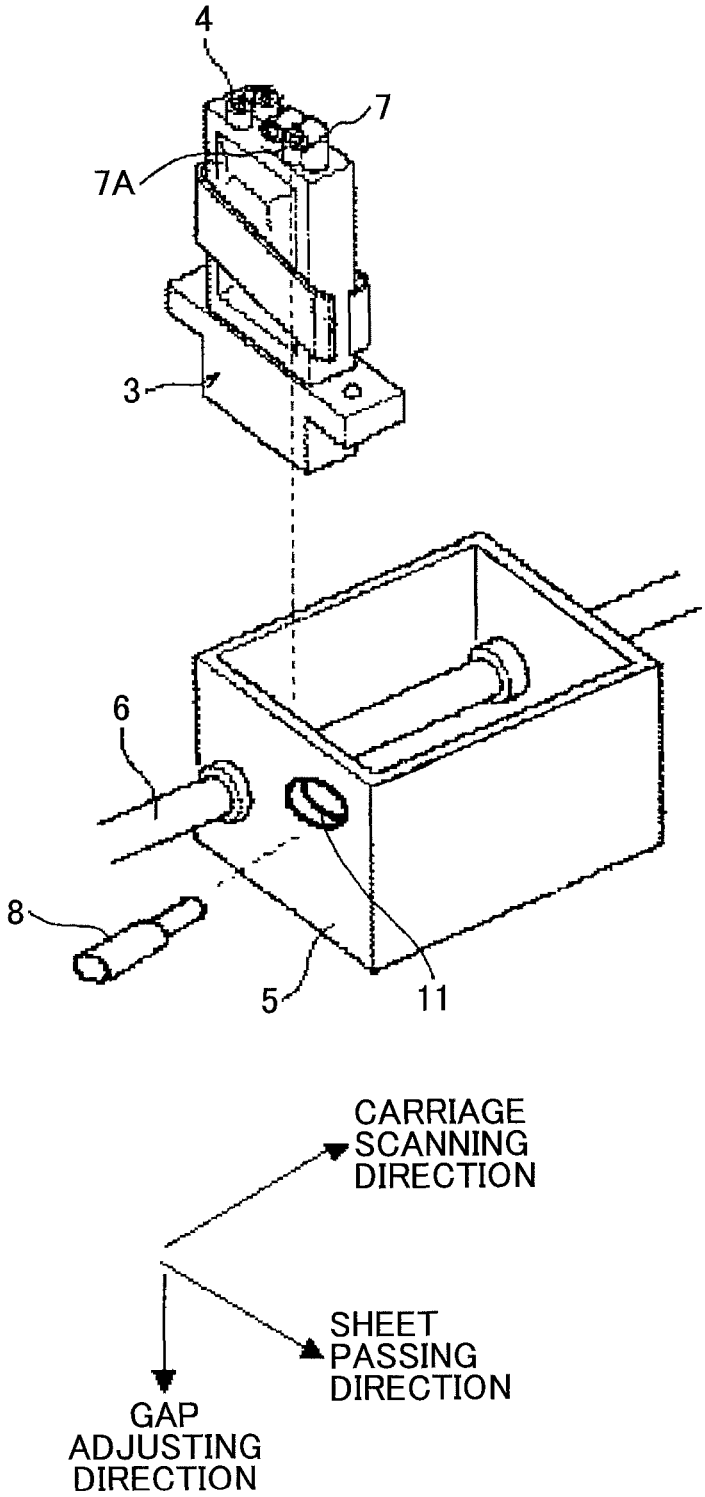
FIG. 1 is an exploded perspective view of an atmospheric air opening device according to a first embodiment of the present invention.
Figure 2:
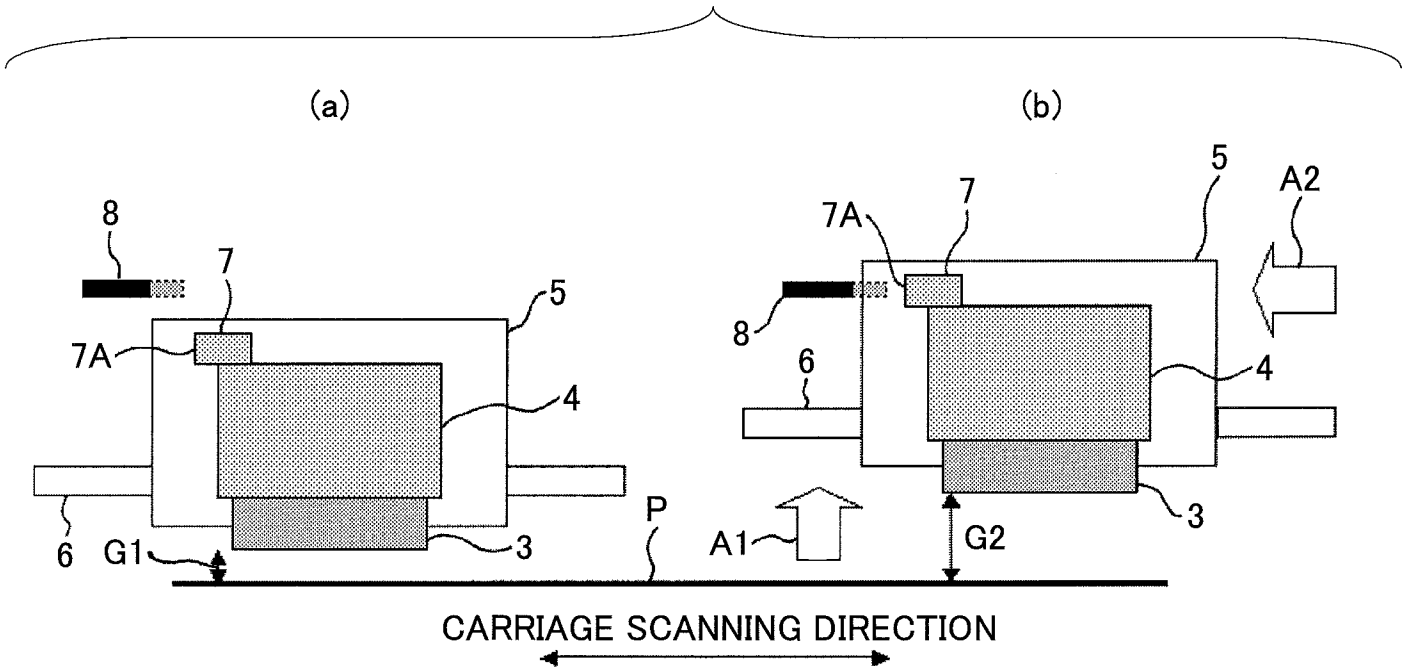
FIG. 2 is for describing the operation of the atmospheric air opening device shown in FIG. 1.

FIG. 1 is an exploded perspective view of an atmospheric air opening device according to a first embodiment of the present invention. FIG. 2 is for describing the operation of the atmospheric air opening device according to the first embodiment of the present invention.

As shown in FIG. 1, the atmospheric air opening device according to the present embodiment does not have the solenoid 9 provided for the atmospheric air opening device of the conventional example described with reference to FIG. 9. In the present embodiment, the pin hole 11 is formed in the side surface of the carriage 5, i.e., in the side surface perpendicular to the support shaft 6 of the carriage 5. The pin hole 11 is formed at a position such that the pin 8 can contact the atmospheric air opening mechanism 7 in the sub tank 4. The atmospheric air opening mechanism 7 is disposed in a direction such that an operation part 7A of the atmospheric air opening mechanism 7 faces the pin hole 11, i.e., in a direction parallel to the support shaft 6. The other elements are configured similarly to the conventional example described with reference to FIG. 9. The operation part 7A is for opening the valve of the atmospheric air opening mechanism 7 so that the inside of the sub tank 4 is open to the atmospheric air (atmospheric air opening operation). The mechanism of the atmospheric air opening mechanism 7 is known in the art and not directly related to the mechanism according to an embodiment of the present invention, and is thus not further described in detail.

The pin 8 is positioned above the carriage 5 under regular circumstances as shown in FIG. 2 (*a*). The carriage 5 moves back and forth along the support shaft 6, at a position at which the head 3 is spaced away from a sheet P by a gap G1 during printing. When an atmospheric air opening operation needs to be performed, the carriage 5 is raised (in a direction indicated by an arrow A1 in FIG. 2 (*b*)), so that the operation part 7A of the atmospheric air opening mechanism 7 is pushed up to a position facing the pin 8, i.e., to a position such that the head 3 is spaced away from the sheet P by a gap G2. Next, a carriage scanning mechanism moves the carriage 5 toward the pin 8 (in a direction indicated by an arrow A2 in FIG. 2 (*b*)). Accordingly, the operation part 7A of the atmospheric air opening mechanism 7 is pushed by the pin 8, so that the sub tank 4 is subjected to an atmospheric air opening operation.

According to the present embodiment, a carriage raising/lowering mechanism and a carriage scanning mechanism are used for performing the atmospheric air opening operation. Therefore, the apparatus can have a simple configuration and a compact size. Under regular circumstances, a regular printing operation can be performed without performing the atmospheric air opening operation.

Second Embodiment

Figure 3:
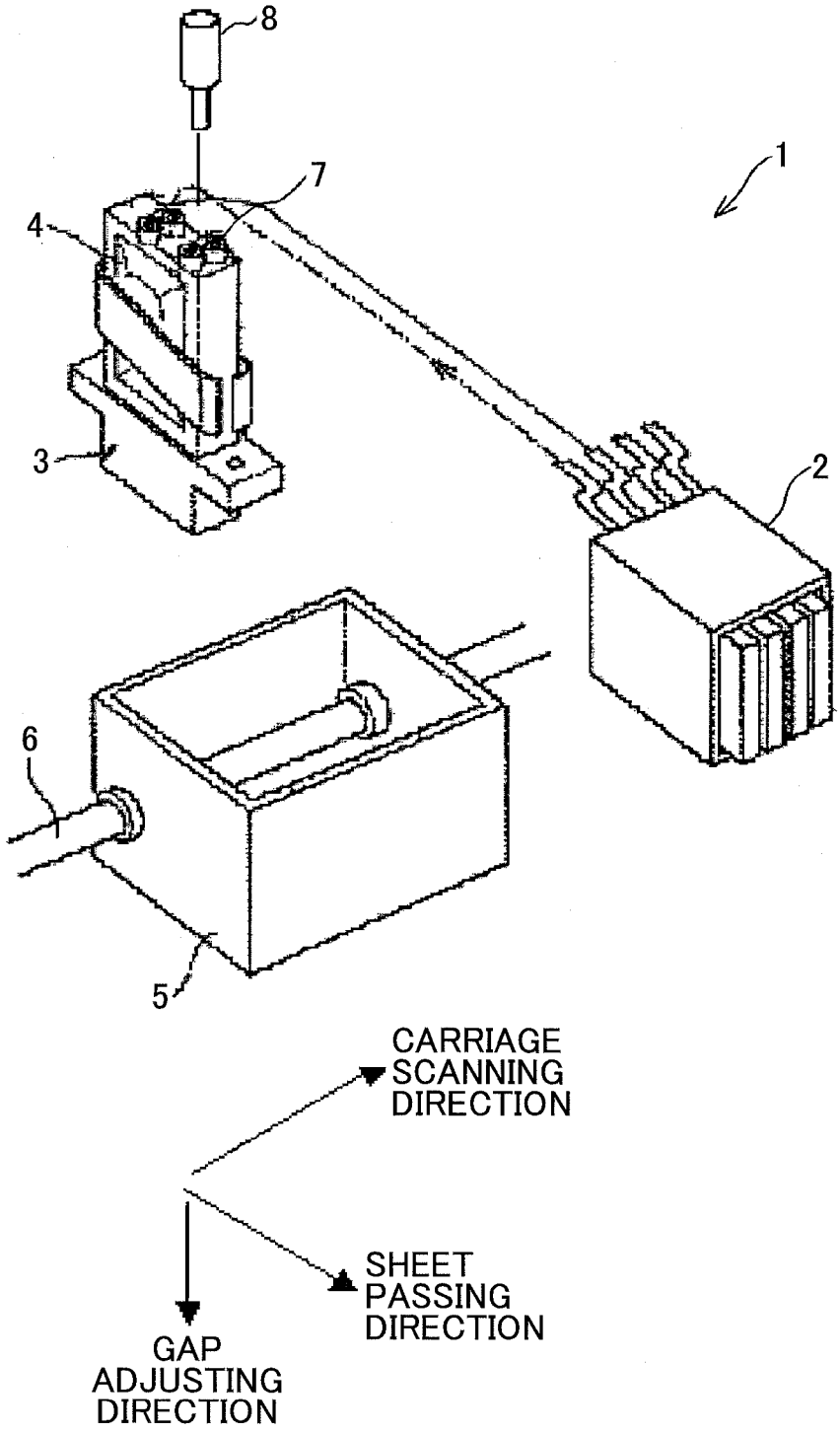
FIG. 3 is an exploded perspective view of an atmospheric air opening device according to a second embodiment of the present invention.
Figure 4:
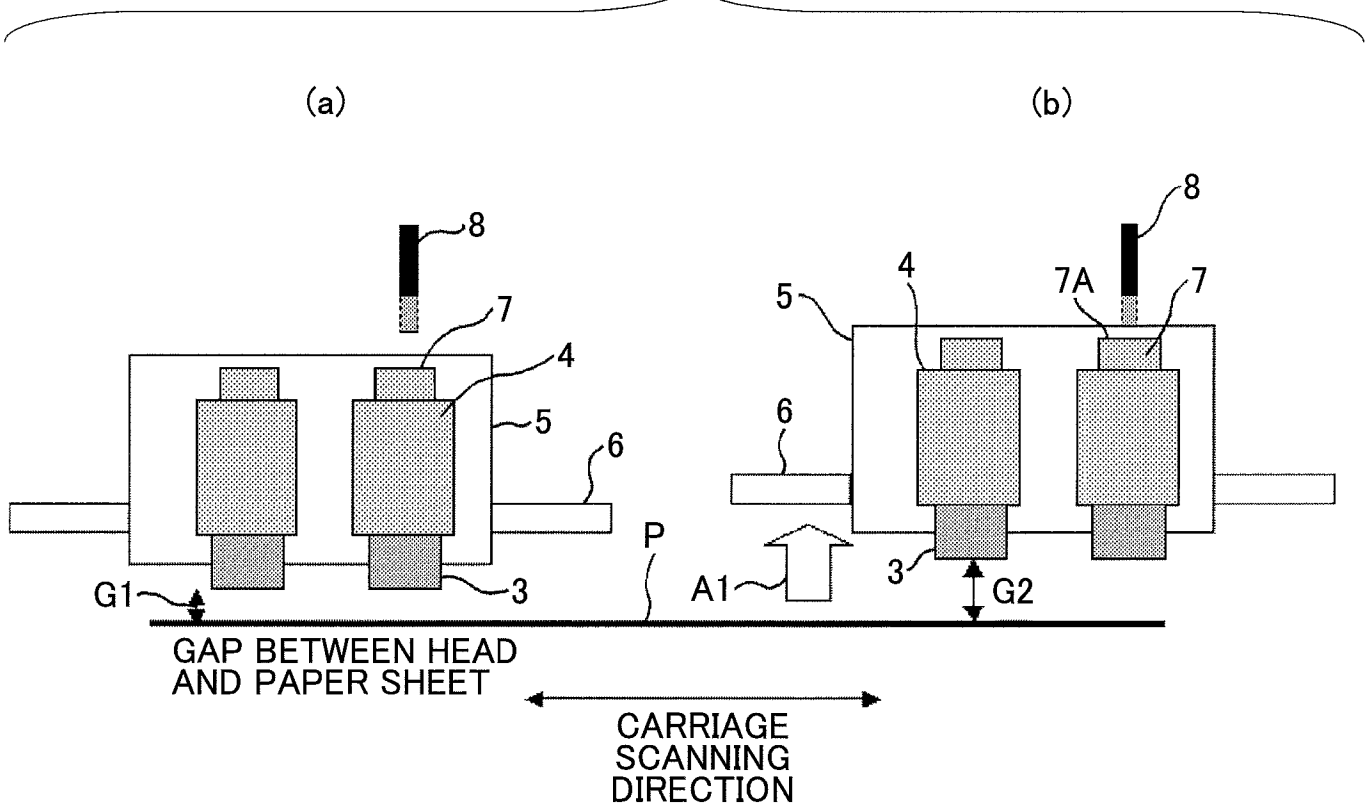
FIG. 4 is for describing the operation of the atmospheric air opening device shown in FIG. 3.

FIG. 3 is an exploded perspective view of an atmospheric air opening device according to a second embodiment of the present invention. FIG. 4 is for describing the operation of the atmospheric air opening device according to the second embodiment of the present invention.

As shown in FIG. 3, the atmospheric air opening device according to the present embodiment does not have the solenoid 9 provided for the atmospheric air opening device of the conventional example described with reference to FIG. 9. Furthermore, the pin 8 is provided above the carriage 5, and the pin hole 11 is not provided. The other elements are configured similarly to the conventional example described with reference to FIG. 9.

In the present embodiment, as shown in FIG. 4, the pin 8 is provided at a predetermined position at an upper part of a path along which the operation part 7A of the atmospheric air opening mechanism 7 of the sub tank 4 moves. When the atmospheric air opening operation is to be performed, as shown in FIG. 4 (*a*), the carriage 5 is moved such that the sub tank 4 to be subjected to the atmospheric air opening operation carried by the carriage 5, comes to a position immediately under the pin 8. Then, the carriage 5 is raised (in a direction indicated by an arrow A1 in FIG. 4 (*b*)) from this position to a position where the gap G1 between the sheet P and the head 3 becomes the gap G2 as shown in FIG. 3 (*b*). Accordingly, the operation part 7A of the atmospheric air opening mechanism 7 contacts the tip of the pin 8, so that the atmospheric air opening operation is performed.

According to the present embodiment, a carriage raising/lowering mechanism and a carriage scanning mechanism are used for performing the atmospheric air opening operation. Therefore, the apparatus can have a simple configuration and a compact size. Under regular circumstances, a regular printing operation can be performed without performing the atmospheric air opening operation.

The second embodiment is different from the first embodiment in that one head 3 can be selected from among plural heads 3 carried by a single carriage 5, as the head 3 to be subjected to an atmospheric air opening operation. When the atmospheric air opening operation is performed, the negative pressure becomes zero, and ink may drip out. Therefore, the head 3 is preferably capped while performing the atmospheric air opening operation. In this respect, the second embodiment is advantageous over the first embodiment because the atmospheric air opening operation may be performed on only a single head.

Third Embodiment

Figure 5:
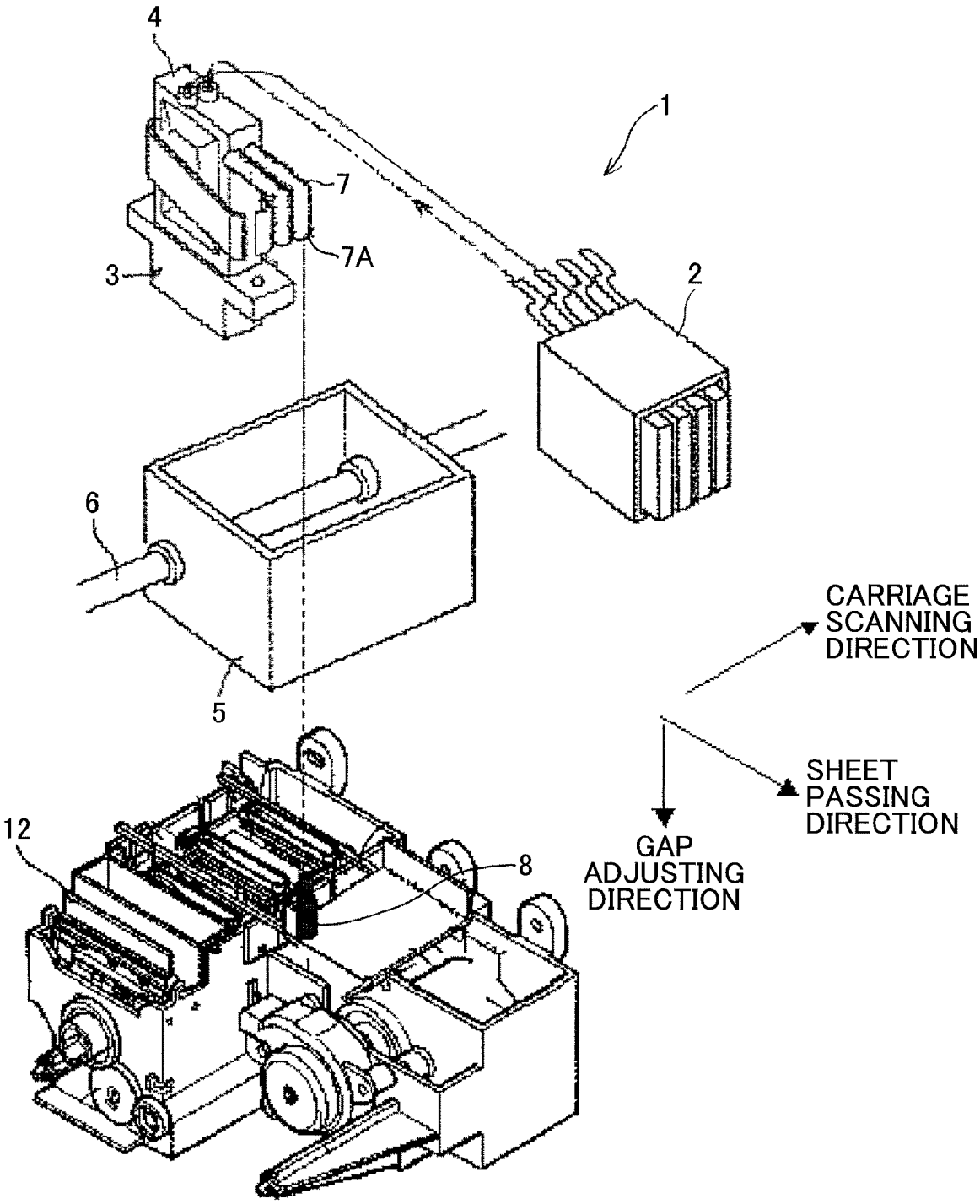
FIG. 5 is an exploded perspective view of an atmospheric air opening device according to a third embodiment of the present invention.
Figure 6:
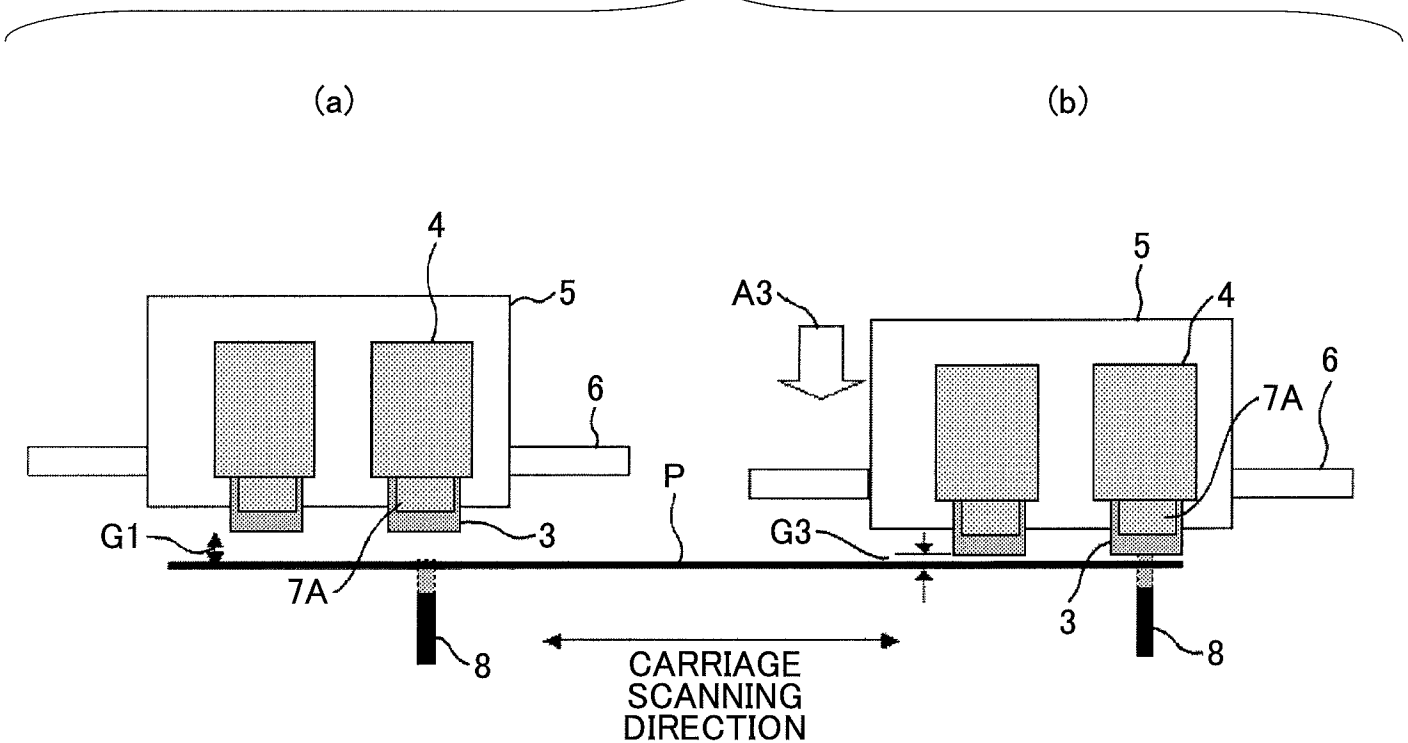
FIG. 6 is for describing the operation of the atmospheric air opening device shown in FIG. 5.

FIG. 5 is an exploded perspective view of an atmospheric air opening device according to a third embodiment of the present invention. FIG. 6 is for describing the operation of the atmospheric air opening device according to the third embodiment of the present invention.

As shown in FIG. 5, the atmospheric air opening device according to the present embodiment is different from the atmospheric air opening device according to the second embodiment of FIG. 3 in that the carriage 5 is lowered to perform the atmospheric air opening operation. The carriage 5 is lowered with the use of a mechanism for adjusting the head gap (hereinafter, a gap adjustment mechanism) 12. Specifically, the pin 8 is positioned below the carriage 5 (FIG. 6 (*a*)). When the gap adjustment mechanism 12 lowers the carriage 5, the tip of the pin 8 located below the carriage 5 presses the operation part 7A of the atmospheric air opening mechanism 7 of the sub tank 4 (FIG. 6 (*b*)), so that the atmospheric air opening operation is performed. Accordingly, the atmospheric air opening mechanism 7 is positioned at the bottom part of the sub tank 4, as shown in FIG. 6.

Furthermore, as shown in FIG. 5, the atmospheric air opening mechanism 7 is protruding out from the side wall of the sub tank 4, and the operation part 7A is positioned above the head 3 and below the below the top edge of the sub tank 4. The pin 8 is disposed at a position corresponding to the operation part 7A, i.e., at a position where the pin 8 contacts the operation part 7A when the carriage 5 is lowered by a predetermined amount so that the valve is opened.

The gap adjustment mechanism 12 is originally provided for the purpose of adjusting the gap between the head 3 and the sheet P, i.e., the gap through which the paper sheet passes, so that printing is performed with an appropriate gap. Thus, the gap adjustment mechanism 12 has a function of moving the head 3 up and down.

Other elements of the third embodiment that are not particularly described are the same as those of the second embodiment.

In the present embodiment, as shown in FIG. 6 (*a*), under regular operations, the gap between the head 3 and the sheet P is G1, and the tip (top tip) of the pin 8 is positioned below the head 3. When an atmospheric air opening operation is to be performed, the operation part 7A of the sub tank 4 in the carriage 5 to be subjected to the atmospheric air opening operation is moved along the support shaft 6 to the position above the pin 8. Then, from this position, the operation part 7A is lowered (in the direction indicated by an arrow A3) as shown in FIG. 6 (*b*). According to this lowering movement, the tip of the pin 8 pushes the operation part 7A to open the valve, and the atmospheric air opening operation is performed.

According to the present embodiment, a gap adjusting mechanism and a carriage scanning mechanism are used for performing the atmospheric air opening operation. Therefore, the apparatus can have a simple configuration and a compact size. Under regular circumstances, a regular printing operation can be performed without performing the atmospheric air opening operation.

The third embodiment is different from the first embodiment in that one head 3 can be selected from among plural heads 3 carried by a single carriage 5, as the head 3 to be subjected to an atmospheric air opening operation. When the atmospheric air opening operation is performed, the negative pressure becomes zero, and ink may drip out. Therefore, the head 3 is preferably capped while performing the atmospheric air opening operation. In this respect, the third embodiment is advantageous over the first embodiment because the atmospheric air opening operation may be performed on only a single head. Furthermore, in the present embodiment, the elements used for the atmospheric air opening operation can be integrally combined with a cap holder, and therefore the present embodiment may have an even simpler configuration than that of the second embodiment.

Fourth Embodiment

Figure 7:
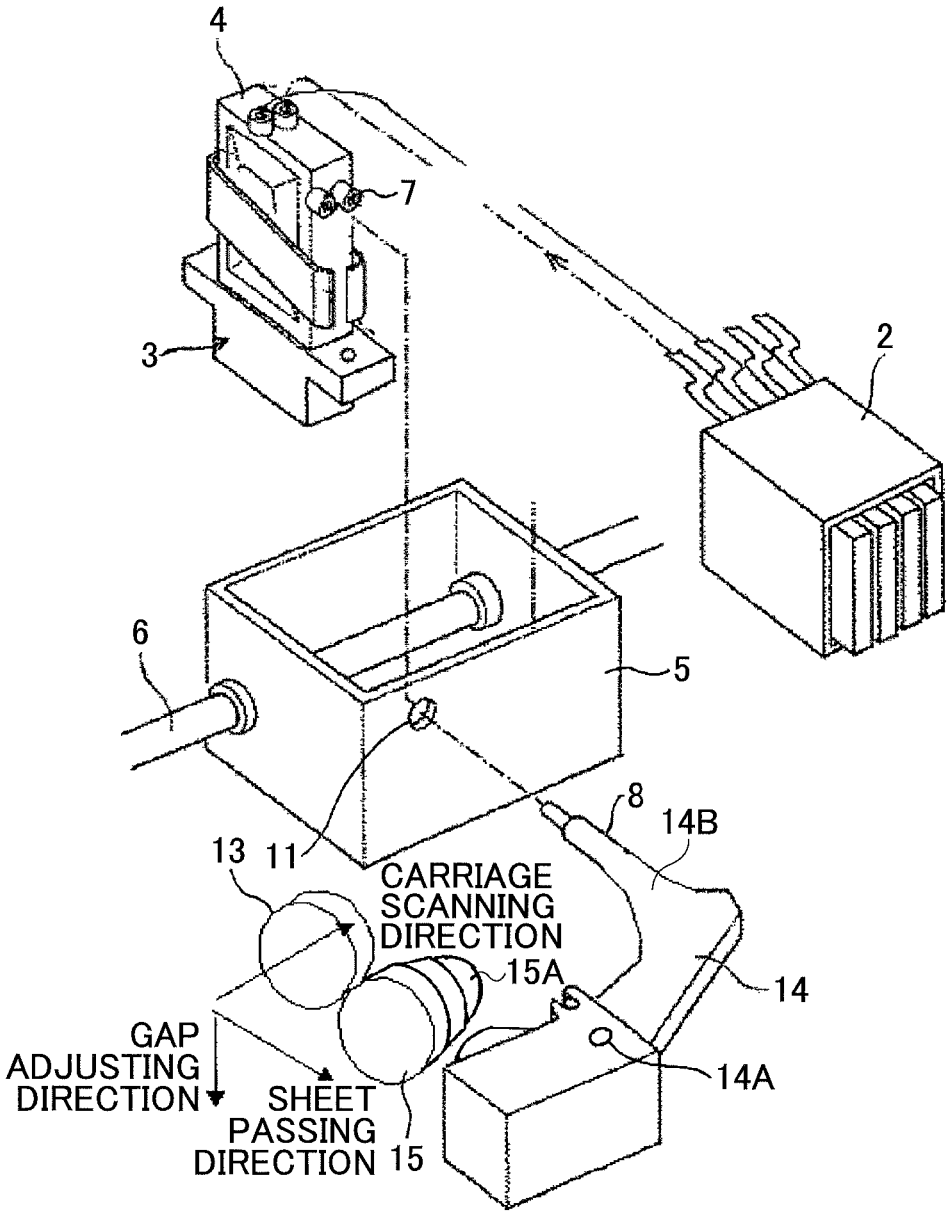
FIG. 7 is an exploded perspective view of an atmospheric air opening device according to a fourth embodiment of the present invention.
Figure 8:
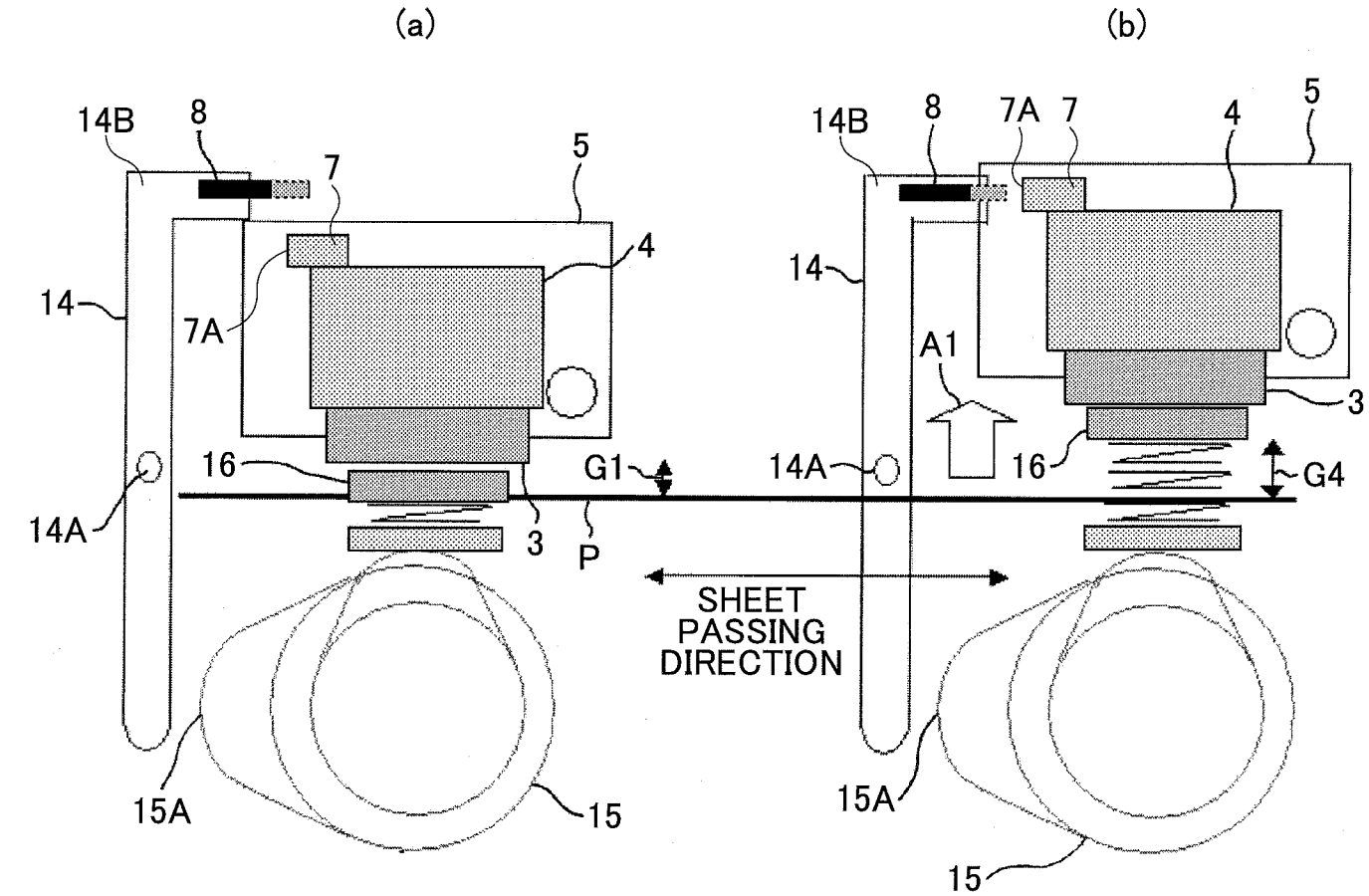
FIG. 8 is for describing the operation of the atmospheric air opening device shown in FIG. 7.

FIG. 7 is an exploded perspective view of an atmospheric air opening device according to a fourth embodiment of the present invention. FIG. 8 is for describing the operation of the atmospheric air opening device according to the fourth embodiment of the present invention.

As shown in FIG. 7, the atmospheric air opening device according to the present embodiment is configured to perform the atmospheric air opening operation with the use of a link cam 14 driven by a maintenance unit (not shown), instead of the solenoid 9 provided for the atmospheric air opening device according to the conventional example described with reference to FIG. 9. Specifically, the maintenance unit includes a unit housing (not shown) and a cap 16 (see FIG. 8) for sealing the head 3. During the printing operation, the cap 16 is opened (FIG. 8 (*a*)), and during a maintenance operation, the cap 16 seals the head 3 (FIG. 8 (*b*)). The other elements that are not particularly described in the present embodiment have the same configurations as those of the conventional example described above. The maintenance head functions as a maintenance recovery mechanism for maintaining or recovering the ink ejecting state of the head 3. Such a mechanism is indispensable in this type of device and known in the art, and is thus not further described in detail.

In the present embodiment, the link cam 14 is configured to sway about a support shaft 14A. The pin 8 is attached to the tip of an operating end of a lever 14B of the link cam 14. A driven end of the link cam 14 is driven by a driving source 13 via a cam mechanism 15. The L-shaped lever 14B of the link cam 14 sways in accordance with the rotation of a cam surface 15A of the cam mechanism 15 that drives the maintenance unit. As shown in FIG. 8 (*a*), during the printing operation, the carriage 5 is lowered to maintain a gap G1 for printing between the head 3 and the sheet P. Accordingly, even if the lever 14B is driven, the pin 8 is positioned above the operation part 7A of the atmospheric air opening mechanism 7, and therefore the pin 8 does not contact the operation part 7A so that the atmospheric air opening operation is not performed.

Meanwhile, when the carriage 5 moves to a maintenance position and switches to a maintenance state, the carriage 5 rises, and the operation part 7A of the atmospheric air opening mechanism 7 reaches a position facing the pin 8 that is attached to the tip of the lever 14B. At the same time, the cap 16 is fixed to the head 3 to seal the ink eject outlet of the head 3. The pressure applied to the cap 16 is adjusted by a spring. In this state, the cam mechanism 15 is driven to cause the link cam 14 to contact the operation part 7A of the atmospheric air opening mechanism 7 to open the valve, so that the inside of the sub tank 3 is open to the atmospheric air. In the present embodiment, the carriage 5 is raised so that the operation part 7A to open the valve reaches a position level with the pin 8. However, in another embodiment, the same function may be implemented by lowering the carriage 5.

According to the present embodiment, a carriage raising/lowering mechanism and a carriage scanning mechanism are used for performing the atmospheric air opening operation. Therefore, the apparatus can have a simple configuration and a compact size. Under regular circumstances, a regular printing operation can be performed without performing the atmospheric air opening operation.

The fourth embodiment is different from the first embodiment in that one head 3 can be selected from among plural heads 3 carried by a single carriage 5, as the head 3 to be subjected to an atmospheric air opening operation. When the atmospheric air opening operation is performed, the negative pressure becomes zero, and ink may drip out. Therefore, the head 3 is preferably capped while performing the atmospheric air opening operation. In this respect, the fourth embodiment is advantageous over the first embodiment because the atmospheric air opening operation may be performed on only a single head. Furthermore, the present embodiment is advantageous when the size of the device in the width direction is restricted, or when the gap G1 between the head and the paper sheet cannot be made narrower than that under regular conditions.

As described above, according to an embodiment of the present invention, the following effects can be achieved.

(1) It is possible to select whether to perform the atmospheric air opening operation by adjusting the gap between the carriage and the sheet. Therefore, there is no need to provide a lever driving mechanism or to control the lever driving mechanism, so that the apparatus can have a simple configuration.

(2) When the gap between the carriage and the sheet is adjusted for performing a printing operation, the atmospheric air opening operation is not performed, and therefore the atmospheric air opening operation can be performed without affecting regular operations.

(3) The atmospheric air opening operation is not performed at the initial stage of a printing operation, and therefore the time taken for printing out the first sheet can be prevented from increasing, and there is no need to take time to transfer to an atmospheric air opening operation after the printing operation.

(4) The atmospheric air opening operation is performed by driving relevant elements such as the carriage and the maintenance unit, and therefore configurations and operations for driving the atmospheric air opening device can be further simplified.

According to one embodiment of the present invention, an image forming apparatus and an atmospheric air opening method are provided, in which the distance between a paper sheet being passed through and an ejecting head is changed by a changing mechanism, and the atmospheric air opening operation is performed in conjunction with the changing operation, and therefore a function that is intrinsically provided in a head unit is used for performing the atmospheric air opening operation, so that the number of components is reduced and the apparatus is simplified.

The present invention is not limited to the specific embodiments described herein, and variations and modifications may be made without departing from the scope of the present invention.

The present application is based on Japanese Priority Patent Application No. 2010-060757, filed on Mar. 17, 2010, the entire contents of which are hereby incorporated herein by reference.

What is claimed is:

1. An image forming apparatus including a main unit and further comprising:

a sub tank that supplies a liquid to an ejecting head that ejects liquid droplets, the sub tank including a negative pressure generating unit that generates a negative pressure inside the sub tank by expanding and contracting as the liquid is supplied to and ejected from the sub tank, and an atmospheric air opening mechanism that performs an atmospheric air opening operation of opening the sub tank to atmospheric air;

a supply mechanism that supplies the liquid in a main tank to the sub tank;

a carriage that bears the ejecting head and the subtank and moves in a main scanning direction at a printing position level above a sheet, wherein the ejecting head, when the carriage bearing the ejecting head is at the printing position level in a vertical direction, ejects the liquid droplets;

a moving mechanism that raises the carriage in the vertical direction from the printing position level to a higher level that is higher in the vertical direction than the printing position level, to change a distance between the sheet and the ejecting head; and an atmospheric air opening control unit that causes the atmospheric air opening mechanism to perform the atmospheric air opening operation in conjunction with the moving mechanism changing the distance between the sheet and the ejecting head, wherein the atmospheric air opening control unit includes a protruding member that is attached to the main unit, and the protruding member is a pin having a leading end that is provided at a predetermined position in the main scanning direction and protrudes at said predetermined position in a downward direction, and the pin includes a lower end disposed at a level that is higher in the vertical direction than the printing position level of the carriage, wherein the moving mechanism raises the carriage that bears the ejecting head to move a nozzle surface of the ejecting head upward in the vertical direction, while the carriage maintains its horizontal state, and wherein the moving mechanism raising the carriage in the vertical direction to the higher level causes the atmospheric air opening mechanism to come into contact with the leading end of the pin which thereby causes the atmospheric air opening mechanism of the sub tank to open the sub tank to the atmosphere air.

2. The image forming apparatus according to claim 1, wherein the pin is disposed at the predetermined position in the main scanning direction, and when the carriage is moved in the main scanning direction to a corresponding position below the predetermined position of the pin, the leading end of the pin protruding in the downward direction faces the atmospheric air opening mechanism of the sub tank from above the atmospheric air opening mechanism, and the atmospheric air opening control unit moves the carriage in the main scanning direction to the predetermined position facing the protruding member, and then causes the moving mechanism to raise the carriage at the predetermined position so that the atmospheric air opening mechanism comes in contact with the protruding member to open the sub tank to the atmospheric air.

3. The image forming apparatus according to claim 1, wherein the leading end of the pin has a shape of a stick and protrudes in the downward direction, and when the carriage is moved to a predetermined position in the main scanning direction, the leading end of the pin is disposed at a position that faces the atmospheric air opening mechanism of the sub tank from above the atmospheric air opening mechanism, and wherein the atmospheric air opening control unit moves the carriage in the main scanning direction to the predetermined position facing the protruding member, and then causes the moving mechanism to raise the carriage at the predetermined position so that the atmospheric air opening mechanism comes in contact with the leading end of the pin to open the sub tank to the atmospheric air.

* * * * *